US006287075B1

(12) United States Patent
Kercher

(10) Patent No.: US 6,287,075 B1
(45) Date of Patent: Sep. 11, 2001

(54) SPANWISE FAN DIFFUSION HOLE AIRFOIL

(75) Inventor: David M. Kercher, Ipswich, MA (US)

(73) Assignee: General Electric Company, Cincinnati, OH (US)

( * ) Notice: Subject to any disclaimer, the term of this patent is extended or adjusted under 35 U.S.C. 154(b) by 166 days.

(21) Appl. No.: 08/955,226

(22) Filed: Oct. 22, 1997

(51) Int. Cl.[7] ..... F01D 5/18
(52) U.S. Cl. ..... 416/97 R; 415/115
(58) Field of Search ..... 416/97 R, 97 A; 415/115

(56) References Cited

U.S. PATENT DOCUMENTS

| | | | | |
|---|---|---|---|---|
| 3,542,486 | | 11/1970 | Kercher . | |
| 4,180,373 | | 12/1979 | Moore et al. . | |
| 4,197,443 | | 4/1980 | Sidenstick . | |
| 4,653,983 | | 3/1987 | Vehr . | |
| 4,664,597 | | 5/1987 | Auxier et al. . | |
| 4,672,727 | | 6/1987 | Field . | |
| 4,684,323 | * | 8/1987 | Field | 416/97 R |
| 4,767,268 | * | 8/1988 | Auxier et al. | 416/97 R |
| 4,893,987 | | 1/1990 | Lee et al. . | |
| 5,356,265 | | 10/1994 | Kercher . | |
| 5,403,158 | * | 4/1995 | Auxier | 416/97 R |
| 5,624,231 | * | 4/1997 | Ohtomo et al. | 416/97 R |
| 5,626,462 | * | 5/1997 | Jackson et al. | 416/97 R |

OTHER PUBLICATIONS

Holland et al, "Rotor Blade Cooling in High Pressure Turbines," J. Aircraft, vol. 17, No. 6, Jun. 1980, pp.: 412–418.

Norton et al, "Turbine Cooling System Design—vol. I—Technical Report," WRDC–TR–2109, vol. 1, Mar. 14, 1990 pp.: Cover, 43, 45, 46, 188 & 189.

* cited by examiner

*Primary Examiner*—Christopher Verdier
(74) *Attorney, Agent, or Firm*—Andrew C. Hess; Rodney M. Young

(57) ABSTRACT

A turbine airfoil includes a leading edge, a trailing edge, and a root and tip spaced apart along a span axis. First and second airfoil sides extend therebetween. A cooling circuit is disposed between the sides for channeling a cooling fluid. A plurality of diffusion fan holes are spaced apart along the span axis in the airfoil first side, with each fan hole increasing in flow area between an inlet at the cooling circuit and an outlet on the airfoil first side disposed coaxially about a centerline fan axis. The fan axis is inclined at an acute span angle, with the outlet being greater in span height than the inlet, and substantially equal in width for increasing coverage of the outlets and film cooling air therefrom along the span axis.

15 Claims, 4 Drawing Sheets

SPANWISE FAN DIFFUSION HOLE AIRFOIL

The US Government has rights in this invention in accordance with Contract No. F33615-91-C-2102 awarded by the Department of the Air Force.

BACKGROUND OF THE INVENTION

The present invention relates generally to gas turbine engines, and, more specifically, to turbine blade and vane cooling.

In a gas turbine engine, air is compressed in a compressor, mixed with fuel and ignited in a combustor for generating hot combustion gases which flow downstream through one or more stages of turbine nozzles and blades. The nozzles include stationary vanes followed in turn by a corresponding row of turbine rotor blades attached to the perimeter of a rotating disk. The vanes and blades have correspondingly configured airfoils which are hollow and include various cooling circuits and features which receive a portion of air bled from the compressor for providing cooling thereof against the heat from the combustion gases which flow therearound.

Turbine vane and blade cooling art is crowded with various features configured for enhancing cooling and reducing the required amount of cooling air for increasing the overall efficiency of the engine while obtaining a suitable useful life for the vanes and blades. For example, typical vane and blade airfoils in the high pressure turbine section of the engine include variously configured cooling holes which extend through the pressure side, or suction side, or both, for discharging a film of cooling air along the outer surface of the airfoil to effect film cooling in a conventional manner.

Since the film cooling air is being discharged from inside the airfoils to outside the airfoils over which the combustion gases flow, a suitable differential pressure must be provided for preventing backflow of the combustion gases into the airfoils. However, excessive differential pressure of the cooling air relative to the combustion gases decreases the effectiveness of the film cooling holes as evaluated by a conventional blowing ratio of the density and velocity of the cooling air relative to the density and velocity of the combustion gases of sufficient strength to blow the coolant film off the airfoil surface downstream of the holes.

It is desirable to reduce the blowing ratio to a suitable value for maximizing performance of the film cooling air while providing sufficient backflow margin to prevent ingestion of the combustion gases into the airfoils during operation.

A common film cooling hole is in the form of a cylindrical aperture inclined axially through the airfoils sides, such as the pressure side, for discharging the film air in the aft direction. The film cooling holes are typically provided in a radial or spanwise row of holes at a specific pitch spacing therebetween. In this way, a row of the film cooling holes discharges corresponding cooling films which form an air blanket for protecting the outer surface of the airfoil from the hot combustion gases during operation.

In the region of the blade leading edge, it is also known to incline the cylindrical film cooling holes at an acute span angle to position the hole outlets radially above the hole inlets and discharge the cooling film radially outwardly from the respective holes.

In order to improve the performance of film cooling holes, it is also conventional to modify their shape to effect diffusion which reduces the discharge velocity of the airflow therethrough and increases static pressure thereof. Diffusion film cooling holes are found in many patented configurations for improving film cooling effectiveness with suitable blowing ratios and backflow margin. A typical diffusion film cooling hole may be conical from inlet to outlet with a suitable increasing area ratio therebetween for effecting diffusion without undesirable flow separation. In this way, diffusion occurs in three axes, i.e. along the length of the hole and the two in-plane orthogonal axes perpendicular thereto.

Other types of diffusion film cooling holes are also found in the prior art including various rectangular shaped holes having different performance. Like the conical diffusion holes, the rectangular diffusion holes also effect diffusion in three dimensions as the cooling air flows therethrough and is discharged along the outer surface of the airfoil.

As indicated above, the various diffusion film cooling holes are typically arranged in rows extending along the span or radial axis of the airfoil, and are positioned closely together as space permits for collectively discharging film cooling air. Since a suitable space must be provided between the adjacent film cooling holes for maintaining suitable strength, for example, the discharge film cooling air does not provide 100% coverage along the span line of the corresponding row of holes.

For example, a typical hole pitch spacing is ten diameters of the circular hole inlet. In the example of the spanwise inclined cylindrical film cooling holes described above, a typical span angle is about 30°, with a 0.25 mm diameter. And, the effective coverage of the row of film cooling holes may be defined by a coverage parameter represented by the span height of the cooling hole along the airfoil outer surface divided by the pitch spacing of adjacent holes. For an inclined cylindrical hole, the outer surface span height of the hole is simply the diameter of the hole divided by the sine of the inclination angle. This results in a 20% coverage value for 30° inclined cylindrical holes at a ten diameter spacing.

This coverage may be compared with a row of conical diffusion holes having 0.25 mm circular inlets increasing in area to circular outlets having a diameter of about 0.46 mm, with the same centerline spanwise hole spacing or pitch of ten inlet diameters. The corresponding coverage value is 36%, which is an improvement over the simple cylindrical holes.

Accordingly, it is desired to further improve film cooling coverage in a row of diffusion holes within the available space while maintaining blade strength.

SUMMARY OF THE INVENTION

A turbine airfoil includes a leading edge, a trailing edge, and a root and tip spaced apart along a span axis. First and second airfoil sides extend therebetween. A cooling circuit is disposed between the sides for channeling a cooling fluid. A plurality of diffusion fan holes are spaced apart along the span axis in the airfoil first side, with each fan hole increasing in flow area between an inlet at the cooling circuit and an outlet on the airfoil first side disposed coaxially about a centerline fan axis. The fan axis is inclined at an acute span angle, with the outlet being greater in span height than the inlet, and substantially equal in width for increasing coverage of the outlets and film cooling air therefrom along the span axis.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
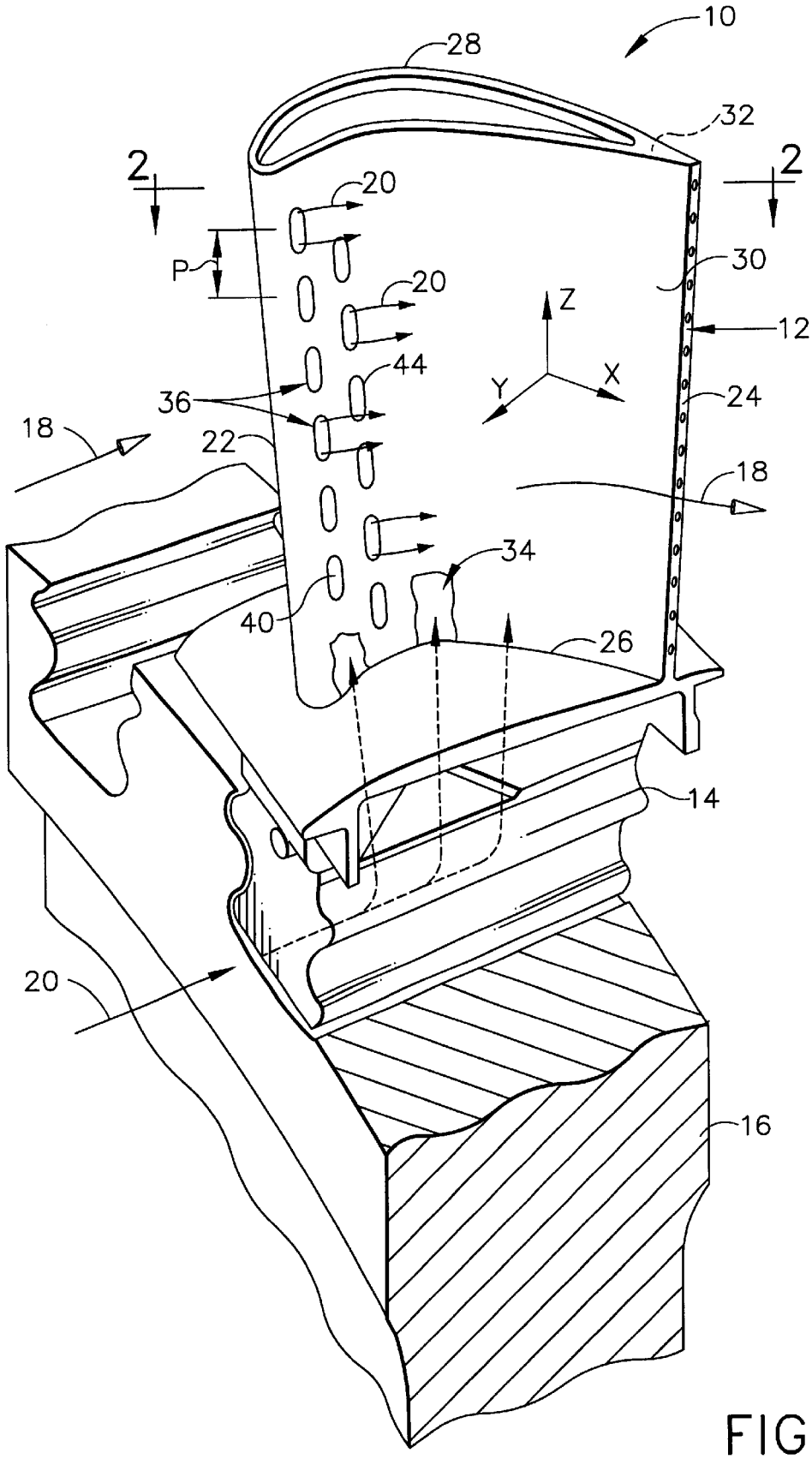
FIG. 1 is an isometric view of an exemplary gas turbine engine turbine rotor blade joined to a perimeter of a rotor disk for extracting energy from hot combustion gases flowable thereover, and including two rows of fan diffusion holes in accordance with two embodiments of the present invention.

Illustrated in FIG. 1 is a turbine rotor blade 10 in accordance with an exemplary embodiment of the present invention. The blade 10 includes an airfoil 12 having an integral dovetail 14 at a radially inner end for mounting the blade to the perimeter of a rotor disk 16 in an annular row of such blades in a conventional manner. In the exemplary embodiment illustrated in FIG. 1, the blade is a first stage high pressure turbine rotor blade disposed immediately downstream of a high pressure turbine nozzle (not shown) which receives hot combustion gases 18 from a combustor of a gas turbine engine (not shown) in a conventional manner. The airfoil 12 and dovetail 14 are suitably hollow for receiving a cooling fluid 20, such as a portion of compressed air bled from a compressor of the engine (not shown), for cooling the blade 10 during operation against the heat from the combustion gases 18.

The airfoil 12 may take any conventional form including a leading edge 22 and an opposite trailing edge 24 spaced axially apart. The airfoil 12 also includes a root 26 defined at a platform portion of the dovetail 14, and an opposite tip 28 spaced radially apart along a span axis Z.

The airfoil 12 also includes a first sidewall or side 30 which is generally concave and defines a pressure side, and an opposite second sidewall or side 32 which is generally convex and defines a suction side which are spaced circumferentially or laterally apart and extend from leading to trailing edges and root to tip.

Figure 2:
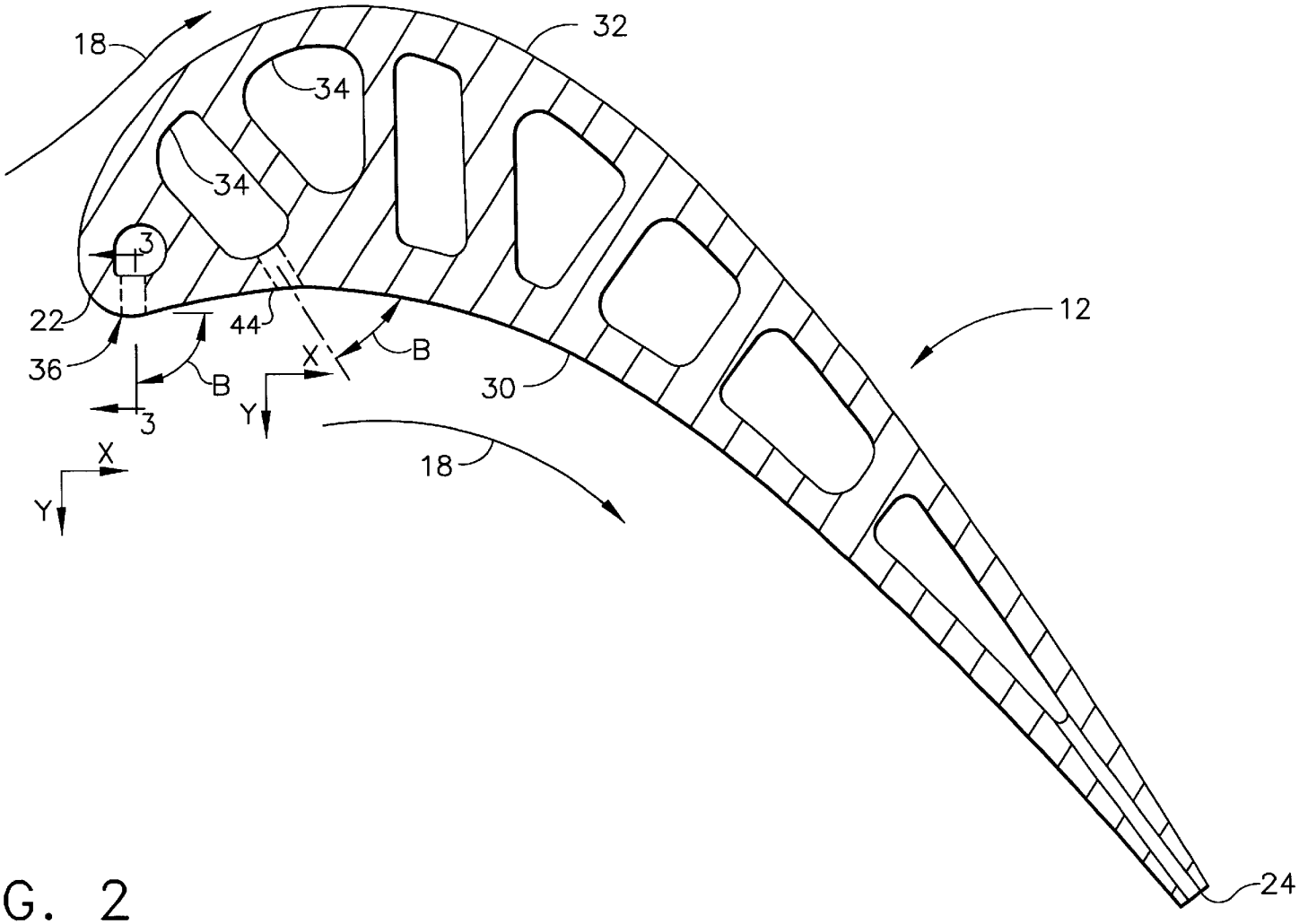
FIG. 2 is a radial sectional view through the turbine airfoil illustrated in FIG. 1 and taken generally along line 2—2.

As shown in more detail in FIG. 2, the airfoil 12, as well as the dovetail 14, includes a cooling circuit or channel 34 disposed between the airfoil sides for channeling the cooling fluid 20 through the airfoil for providing cooling thereof during operation. The cooling circuit 34 may take any conventional form including various channels extending through the airfoil 12, such as along the leading edge thereof, along the trailing edge thereof, and along the mid-chord therebetween in the form of a suitable serpentine cooling circuit. In the exemplary embodiment illustrated in FIG. 1, the cooling fluid, or air, 20 is suitably channeled from the engine compressor and through suitable apertures between the blade dovetail 14 and its respective axial dovetail slot in the disk 16 in any conventional manner.

Although the specific airfoil 12 illustrated in FIG. 1 is shown as a portion of the turbine rotor blade 10, the invention applies equally as well to any form of airfoil such as those also found in the stationary turbine nozzle (not shown) which are fixed to radially outer and inner bands through which the cooling air is conventionally channeled. In either embodiment of rotor blade or stator vane, the specific airfoil 12 is suitably configured for channeling the combustion gases 18 to extract energy therefrom for rotating the disk 16 for obtaining useful power.

In accordance with the present invention, a plurality of leading edge diffusion fan holes 36 are spaced apart along the span axis Z in a colinearly aligned row for discharging the cooling air 20 from inside the airfoil 12 along its outer surface to provide cooling air films therealong. In the exemplary embodiment illustrated in FIG. 1, the fan holes 36 extend through the airfoil first or pressure side 30 in flow communication with the cooling circuit 34 therein.

Figure 3:
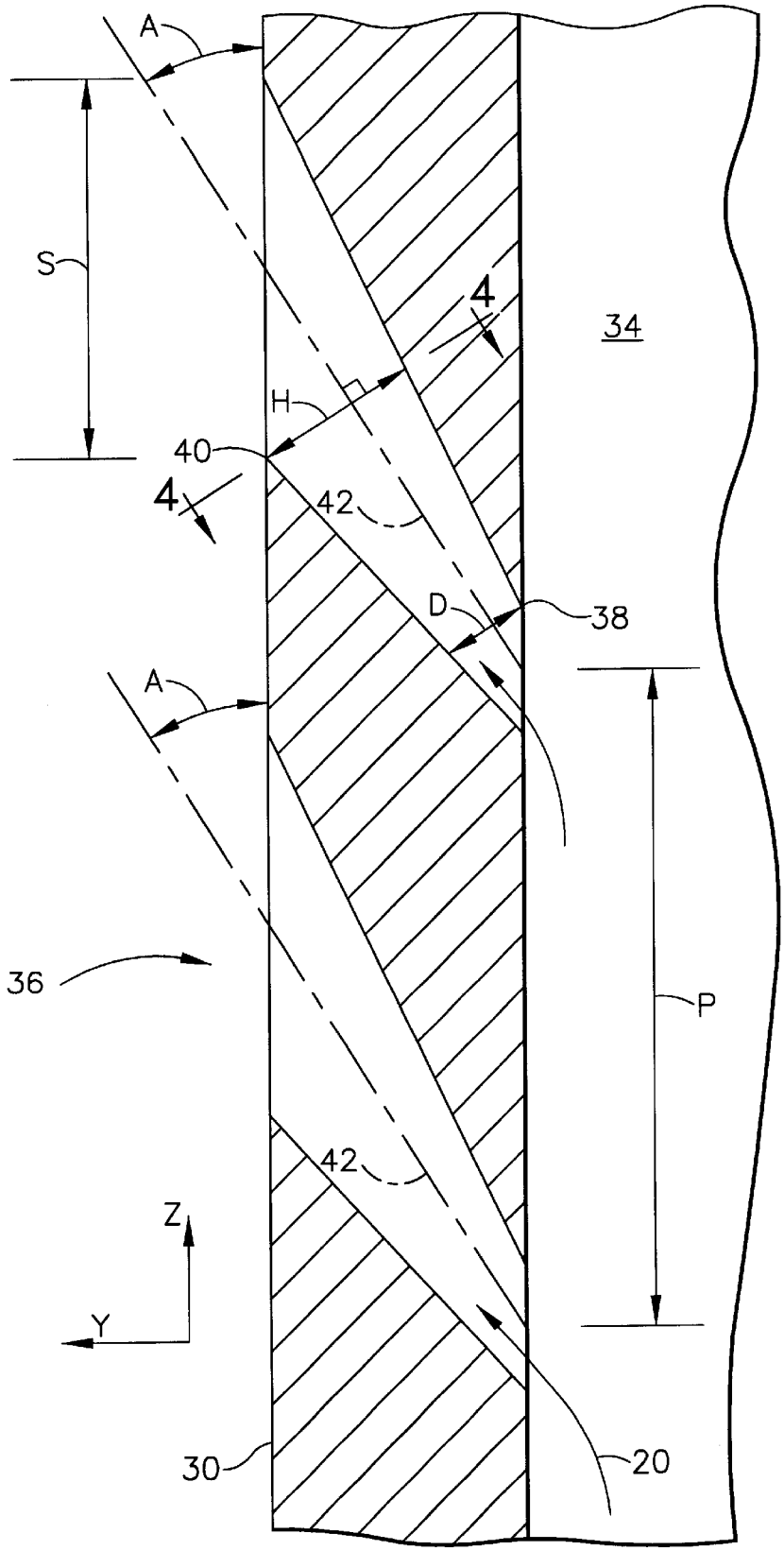
FIG. 3 is a span sectional view through the airfoil illustrated in FIG. 2 and taken along line 3—3 through a leading edge row of fan diffusion holes in accordance with an exemplary embodiment of the present invention.

As shown in more particularity in FIG. 3, each of the fan holes 36 increases in flow area between an inlet 38 disposed in flow communication with the cooling circuit 34, and an outlet 40 disposed in the airfoil first side 30 for diffusing the cooling air channeled therethrough to create a corresponding film of the cooling air along the airfoil first side 30 from the respective outlets 40. Each of the fan holes 36 has a centerline fan hole axis 42 with both the inlet 38 and outlet 40 being disposed coaxially therewith.

Figure 4:
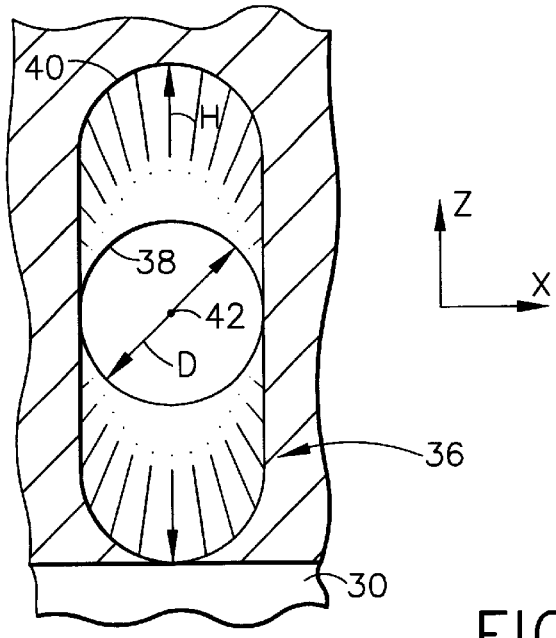
FIG. 4 is a sectional view through an exemplary one of the fan diffusion holes illustrated in FIG. 3 and taken along line 4—4.

As shown in FIGS. 3 and 4, the fan hole inlet 38 is preferably circular perpendicular to the fan axis 42, with a width or diameter D. The fan hole outlet 40 is preferably a race-track oval perpendicular to the fan axis 42, with opposing semicircular or arcuate radially outer and inner sides, and opposite straight lateral sides which are aligned coplanar with opposite sides of the fan hole inlet 38. The fan hole outlet 40 is greater in span height H along the fan axis 42 than the inlet 38 whose span height is also its diameter D. And, the fan hole outlet 40 is substantially equal in width with the inlet 38 about the fan axis 42.

As shown in FIG. 3, the fan axis 42 is inclined in accordance with the present invention at an acute span angle A from the span axis Z, which in conjunction with the fan shape of the holes 36 are effective for increasing coverage of the fan hole outlet 40 and cooling films therefrom along the span axis Z. The so inclined fan hole 36 projects the inlet 38 and outlet 40 along the inner and outer surfaces of the airfoil first side with larger span extents, D/Sin (A) and H/Sin (A), respectively.

A conventional conical or rectangular diffusion hole effects diffusion in three dimensions along the centerline axes thereof and the two orthogonal axes in the planes perpendicular thereto. In contrast, the fan diffusion holes 36 as illustrated in FIGS. 3 and 4 effect diffusion solely in two dimensions, i.e. along the fan axis 42 and the span axis Z. The fan holes 36 therefore diverge solely along the span axis Z, and symmetrically about the fan axis 42 both radially outwardly and radially inwardly.

For example, the arcuate outer and inner surfaces of each of the fan holes 36 may diverge at suitably small angles from the inlet 38 to the outlet 40 to effect a suitable diffusion area ratio of about 3.5:1. Since the fan holes 36 are spanwise inclined, the circular inlet 38 illustrated in FIG. 3 has an elliptical projection or profile along the inner surface of the first side 30, whereas the outlet 40 has a taller oval projection along the outer surface of the airfoil first side 30.

In the exemplary embodiment illustrated in FIGS. 1 and 2, the fan holes 36 are disposed perpendicularly to the airfoil first side 30 without any compound angle inclination therein. A local reference coordinate system may be defined as illustrated in FIGS. 1 and 2 to include the span axis Z in the engine radial direction. A generally axial axis X is disposed parallel to the outer surface of the airfoil 12. And, an orthogonal normal axis Y extends perpendicularly outwardly from the outer surface of the airfoil 12.

As shown in FIG. 3, the fan axis 42 has a spanwise inclination defined by the span angle A as measured from the span axis Z perpendicular to the X-Y plane. As shown in FIG. 2, the orientation of the fan holes 36 may also be defined by an axial inclination angle B in the X-Y plane as measured from the outer surface of the airfoil 12 for the local axial axis X. For the exemplary fan holes 36 disposed adjacent the airfoil leading edge 22, the axial inclination angle B has a value of 90° which positions the fan holes 36 and the fan axis 42 thereof axially perpendicular to the airfoil outer surface without axial inclination or compound angle. The sole inclination angle is the span angle A as illustrated in FIG. 3. In a preferred embodiment, the span angle A is about 30° for discharging the cooling air 20 radially upwardly from the fan hole inlet 38 to the respective outlet 40.

As additionally shown in FIG. 3, the fan holes 36 are disposed at a spanwise pitch spacing P of about ten diameters of the fan holes inlets 38. As indicated above, an exemplary area ratio of the fan holes 36 is about 3.5:1 between the inlets 38 and outlets 40 thereof. For example, the inlets 38 may have a diameter D of about 0.25 mm; the outlets 40 have a span height H of about 0.73 mm; and the pitch spacing P is ten diameters or about 2.54 mm; which results in a projected span height S of each outlet 40 at the outer surface of the airfoil first side 30 of about 1.45 mm. The coverage equation results in a coverage value of about 57% which is the projected span height (1.45 mm) divided by the pitch spacing (2.54 mm). This 57% exit coverage for the fan diffusion holes 36 is about 58% larger than the 36% coverage of the conical diffusion holes described above; and about 185% greater than the 20% coverage for the cylindrical holes described above all at the same centerline spanwise hole pitch spacing and inlet hole diameter.

Accordingly, the two-dimensional diffusion fan holes 36 provide a substantial increase in exit coverage within the available space at comparable pitch spacings. Although the fan holes 36 require a greater span height than that for conical diffusion holes for effecting the same area ratio, they also increase exit coverage without being excessively close together in the span direction. As shown in FIG. 3, the ten diameter pitch spacing P is measured at the inlets 38 between the corresponding fan axes 42. The perpendicular distance between the adjacent fan axes 42 is about 1.27 mm in the exemplary embodiment and provides sufficient material between the outlets 40 as they converge together between adjacent fan holes 36.

The leading edge fan holes 36 may be disposed in various rows around the leading edge 22 on both the pressure side 30 and the suction side 32 as desired. The relatively large expansion area ratio of about 3.5:1 can create an aerodynamic standing wave or normal shock near the hole inlet for fan holes in the airfoil suction side 32 having pressure ratios of about 1.5 and higher according to analysis. This normal shock decreases the total pressure of the cooling air across the shock and facilitates flow diffusion. Accordingly, the exit velocity of the cooling air discharged from the fan holes may be reduced on the average by about 3.5:1 from the inlet flow velocity.

The substantial area ratio and velocity reduction effected by the fan holes 36 in turn significantly reduces the aerodynamic blowing ratio of the ejected cooling film. Lowering the blowing ratio significantly increases the local and average spanwise film effectiveness downstream of the holes and therefore increases the cooling effectiveness for the same cooling flow. This improvement in adiabatic film cooling effectiveness is accomplished by preventing undesirable blowoff or flow separation of the cooling film from the airfoil outer surface immediately downstream of the fan holes.

The increased coverage of the fan holes 36 in combination with the reduced blowing ratio collectively increase downstream film cooling effectiveness. The fan holes 36 may therefore be used at any suitable location from the leading edge to downstream mid-chord locations for increasing the effectiveness of the film cooling therefrom, and correspondingly reduce metal temperatures for the same inlet hole geometry, the same pitch spacing, and also the same cooling flow as compared to conventional diffusion holes.

Furthermore, the more effective fan diffusion holes 36 may be used to allow an increase in turbine inlet gas temperature with little or no increase in engine cycle chargeable and non-chargeable cooling for improving overall engine performance. Or, the increased cooling effectiveness of the fan diffusion holes 36 may be used to allow reductions in turbine chargeable and non-chargeable. cooling air for the same turbine inlet conditions, and therefore offer improvement in current film cooled turbine overall engine performance.

As initially shown in FIGS. 1 and 2, the airfoil 12 may include another row of fan diffusion holes disposed mid-chord axially between the leading and trailing edges 22 and 24, and referred to as gill fan holes 44. As shown in FIG. 2, the gill fan holes 44 are substantially identical to the leading edge fan holes 36 but are preferably additionally inclined between the leading and trailing edges at an acute axial inclination angle B to effect compound angle inclination of the fan holes 44 to the airfoil first side 30 for example.

Figure 5:
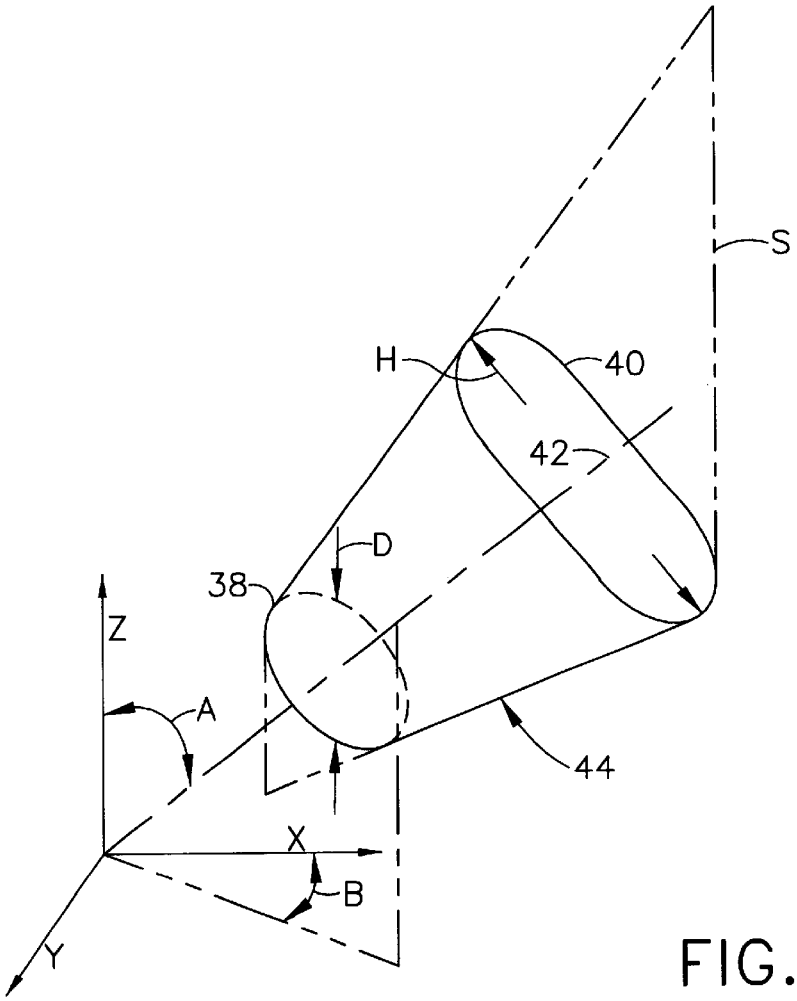
FIG. 5 is a schematic representation of one of the fan diffusion holes in the form of mid-chord gill holes in the second row of the turbine blade illustrated in FIG. 1 in accordance with a second embodiment of the present invention.

The compound angle gill diffusion holes 44 which extend through the airfoil first side 30 are shown schematically in FIG. 5 in solid and phantom lines, and are readily defined using a polar coordinate system for example. The XYZ coordinate system illustrated in FIG. 5 is the same as that illustrated in FIG. 1, with the span axis designated Z, the axial axis X being parallel to the outer surface of the airfoil, and the normal axis Y being perpendicular thereto. Like the leading edge fan holes 36 illustrated in FIG. 3 for example, the gill holes 44 illustrated in FIG. 5 have a suitable acute span angle A measured from the span axis Z. And, the gill holes 44 additionally have an acute axial inclination angle B measured from the axial axis X along the outer surface of the airfoil 12 toward the normal axis Y. The two inclination angles A, B position the centerline fan axis 42 at the suitable compound angle inclination through the airfoil sidewall.

In a preferred embodiment, the span angle A is about 45° and the axial inclination angle B is about 30°. In an exemplary embodiment, the inlet diameter D is about 0.25 mm; the outlet span height H is about 0.71 mm, having a projected height at the airfoil outer surface of 1.02 mm; and the pitch spacing is 5.1 D or about 1.3 mm. The corresponding exit coverage is about 78%.

This 78% coverage for the compound angle gill holes 44 in this exemplary embodiment may be directly compared with a cylindrical gill hole also having a span angle of about 45° and an axial inclination angle of about 35°, with the same pitch spacing and inlet diameter, which yields a coverage of about 28%, with the 78% gill hole coverage being 178% greater.

The gill hole coverage may also be compared with the leading edge fan holes 36 having an axial inclination B of about 35°, but with no span inclination angle, i.e. the span angle A being 90°, which yields an exit coverage of about 55% for the same inlet diameter size and pitch spacing. The gill hole coverage of 78% is about 42% greater than the 55% coverage of such axially inclined race-track holes only.

These comparison coverages clearly support the unexpected increase in coverage by utilizing the two-dimensional, oval race-track shape diffusion holes with at least a suitable acute span angle A, and also with the compound inclination axial angle B.

In both embodiments, the significant improvement due to increased coverage may be obtained with relatively simple fan diffusion holes located around the outer surface of the airfoil 12 where desired. The holes may be conventionally manufactured in the airfoil casting using suitable electrical discharge machining or laser drilling for example. The spanwise inclination of the holes 36, 44 improves the use of conventional laser drilling which allows the laser beam to project downwardly through the outer surface of the airfoil in forming the holes and project downwardly inside the respective channels of the cooling circuit 34 for preventing damage to adjacent walls or ribs of the cooling circuit inside the airfoil 12.

If desired, the respective hole inlet 38 may be in the form of a short, cylindrical, constant diameter section to accommodate variations in casting wall thickness of the airfoil 12, and thusly ensure proper metering at the inlet minimum area for quality assurance of the airfoil manufactured flow-check requirements.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A turbine airfoil comprising:

a leading edge and a trailing edge spaced axially apart;

a root and a tip spaced apart along a span axis;

a first side and a second side spaced laterally apart;

a cooling circuit disposed between said first and second sides for channeling a cooling fluid therethrough to cool said airfoil;

a plurality of diffusion fan holes spaced apart along said span axis in said first side, each of said fan holes increasing in flow area between an inlet at said cooling circuit and an outlet on said first side disposed coaxially about a centerline fan axis for diffusing said cooling fluid channeled therethrough to create a film of said cooling fluid along said first side from said outlet; and said fan axis being inclined at an acute span angle from said span axis, with said outlet being greater in span height than said inlet, and substantially equal in width with said inlet for increasing coverage of said outlets and films therefrom along said span axis.

2. An airfoil according to claim 1 wherein said fan holes diverge solely along said span axis, and symmetrically about said fan axis.

3. An airfoil according to claim 2 wherein:

said fan hole inlet is circular perpendicular to said fan axis; and said fan hole outlet is oval perpendicular to said fan axis, with opposing arcuate sides, and opposing straight sides aligned coplanar with opposite sides of said fan hole inlet.

4. An airfoil according to claim 3 wherein said f an holes are axially perpendicular to said airfoil first side without compound angle inclination therein.

5. An airfoil according to claim 4 wherein said span angle is about 30° for discharging said cooling fluid radially upwardly from said fan hole inlets to outlets.

6. An airfoil according to claim 5 wherein said fan holes are disposed adjacent said airfoil leading edge.

7. An airfoil according to claim 6 wherein said fan holes are disposed at a spanwise pitch spacing of about ten diameters of said fan hole inlets, have an area ratio of about 3.5:1 between said inlets and outlets thereof, and said coverage is about 57%.

8. An airfoil according to claim 7 wherein said airfoil first side is a generally concave pressure side, and said airfoil second side is a generally convex suction side.

9. An airfoil according to claim 3 wherein said fan holes are additionally inclined between said leading and trailing edges at an acute axial inclination angle B to effect compound angle inclination of said fan holes through said airfoil first side.

10. An airfoil according to claim 9 wherein:

said span angle is about 45° for discharging said cooling fluid radially upwardly from said fan hole inlets to outlets; and said axial inclination angle is about 30° for discharging said cooling fluid axially aft from said fan hole inlets to outlets.

11. An airfoil according to claim 10 wherein said fan holes are disposed mid-chord axially between said leading and trailing edges.

12. An airfoil according to claim 11 wherein said fan holes are disposed at a spanwise pitch of about 5.1 diameters of said fan hole inlets, have an area ratio of about 3.5:1 between said inlets and outlets thereof, and said coverage is about 78%.

13. An airfoil according to claim 12 wherein said airfoil first side is a generally concave pressure side, and said airfoil second side is a generally convex suction side.

14. A turbine airfoil comprising:

first and second sides extending along a span axis between a root and a tip, and extending axially between opposite leading and trailing edges;

a cooling circuit disposed between said first and second sides for channeling a cooling fluid therethrough to cool said airfoil;

a row of film cooling holes spaced apart along said span axis in said first side, and each hole including an inlet disposed in flow communication with said cooling circuit, and an outlet on said first side; and said hole outlet being oval along said span axis, and being greater in span height than said inlet, and substantially equal in width with said inlet.

15. An airfoil according to claim 14 wherein said fan holes diverge between said inlets and outlets solely along said span axis.

* * * * *